US006615628B2

(12) United States Patent
Lou

(10) Patent No.: US 6,615,628 B2
(45) Date of Patent: Sep. 9, 2003

(54) PICKLOCK-PROOF KEY SLOT FOR A LOCK DEVICE AND A KEY THEREOF

(76) Inventor: Chi-Wen Lou, P.O. Box 96-405, Taipei 106 (TW)

( * ) Notice: Subject to any disclaimer, the term of this patent is extended or adjusted under 35 U.S.C. 154(b) by 0 days.

(21) Appl. No.: 09/909,918

(22) Filed: Jul. 20, 2001

(65) Prior Publication Data

US 2003/0015008 A1 Jan. 23, 2003

(51) Int. Cl.[7] ..... E05B 19/06

(52) U.S. Cl. ..... 70/409; 70/407; 70/420; 70/453; 70/493

(58) Field of Search ..... 70/419–421, 409, 70/453, 493, 358, 402, 454, 405–407

(56) References Cited

U.S. PATENT DOCUMENTS

| | | | | | |
|---|---|---|---|---|---|
| 3,499,304 | A | * | 3/1970 | Naujoks | |
| 3,742,744 | A | * | 7/1973 | Lumme | 70/358 |
| 4,116,025 | A | * | 9/1978 | Wolter | 70/358 |
| 4,168,617 | A | * | 9/1979 | Prunbauer | 70/406 |
| 4,213,316 | A | * | 7/1980 | Tietz | 70/421 X |
| 4,368,629 | A | * | 1/1983 | Prunbauer | 70/406 |
| 4,416,128 | A | * | 11/1983 | Steinbrink | 70/407 X |
| 4,612,787 | A | * | 9/1986 | Prunbauer | 70/409 X |
| 4,653,298 | A | * | 3/1987 | Tietz | 70/406 |
| 4,660,396 | A | * | 4/1987 | Garro | 70/358 |
| 4,787,225 | A | * | 11/1988 | Hauser | 70/401 |
| 4,856,309 | A | * | 8/1989 | Eizen | 70/359 |
| 4,964,288 | A | * | 10/1990 | Braun et al. | 70/358 X |
| 5,123,268 | A | * | 6/1992 | Eizen | 70/359 |
| 5,222,383 | A | * | 6/1993 | Fann et al. | 70/358 |
| 5,287,712 | A | * | 2/1994 | Sieg | 70/406 |
| 5,475,998 | A | * | 12/1995 | Raskevicius et al. | 70/495 |
| 5,533,369 | A | * | 7/1996 | Valdajos-Gallego | 70/358 X |
| 5,682,779 | A | * | 11/1997 | Dolev | 70/378 X |
| 5,839,308 | A | * | 11/1998 | Eizen et al. | 70/359 X |
| 5,894,750 | A | * | 4/1999 | Liaw | 70/378 X |
| 6,105,404 | A | * | 8/2000 | Field et al. | 70/406 X |
| 6,145,357 | A | * | 11/2000 | Stefanescu | 70/406 |

FOREIGN PATENT DOCUMENTS

| | | | | |
|---|---|---|---|---|
| DE | 1553522 | * | 4/1970 | 70/405 |
| DE | 2344473 | * | 5/1975 | 70/493 |
| DE | 2947402 | * | 5/1981 | 70/406 |
| DE | 3021128 | * | 12/1981 | 70/406 |
| FR | 2551794 | * | 3/1985 | 70/493 |

* cited by examiner

*Primary Examiner*—Lloyd A. Gall
(74) *Attorney, Agent, or Firm*—Troxell Law Office PLLC

(57) ABSTRACT

A picklock-proof key slot for a lock device and a key thereof, which comprises a rotary cylinder and a lock casing, between which plural upper tumblers and lower tumblers are furnished; the center of the rotary cylinder is provided with a key slot; under lock up condition, the lower tumblers are pushed into the key slot; the center of the tumbler groove is furnished with a salient plate, of which both sides are furnished with symmetrical guide slots; a guide slot is furnished between the two symmetrical guide plates on the key plate; a plurality of unlock-tumbler holes is furnished on the guide slot between the two guide plates; the hole has a curved surface to fit with the curve surfaces on both sides of the lower tumbler so as to reduce the pushing-up space of the lower tumbler, and also to reduce the possibility of unlocking the lock device with a master key to push the lower tumbler.

6 Claims, 6 Drawing Sheets

PICKLOCK-PROOF KEY SLOT FOR A LOCK DEVICE AND A KEY THEREOF

BACKGROUND OF THE INVENTION

1. Field of the Invention

This invention relates to a lock device, and particularly to a picklock-proof key slot for a lock device and a key thereof.

2. Description of the Prior Art

In the conventional lock devices, the lock-up relation between the outer lock cylinder and the inner lock cylinder is different because of the shapes of the keys being different; such lock devices may be classified as spiral lock, tube lock, hub-shaped lock, straight slot lock and flat plate lock; in the flat-plate lock the inner lock cylinder is furnished with a key hole, which designed at an angle of 90 degrees to the tumbler grooves. The flat surface of the key is furnished with tumbler grooves; the aforesaid lock structure is deemed the most difficult lock device to be picked because of the key slot of such lock device is set at an angle of 90 degrees from the inner tumbler grooves; the flat plate of the key has a thickness of 3.0 mm; if a master key is plugged into the key slot to pick, the master key is unable to push the lower tumblers to move up and down on a straight line; it can only move and push the lower tumblers at an incorrect position, i.e., along a straight line, and then the lock device can be unlocked.

In the conventional technology of lock device, the manufacturing precision is unable to achieve the effectiveness as desired as a matter of convenience during manufacturing. The lock device comprises an outer lock cylinder and an inner lock cylinder; between the upper tumblers and the lower lock cylinders, there is a curved unlocking tangent; the lock device can be picked easily with a master key because of the design of the key slot in the inner lock cylinder. In a straight slot lock, the width of the key slot is 2.0 mm; the diameter of a master key is ranging from 0.8 mm to 1.0 mm; the motion space for the lower tumblers in the key slot is ranging from 5.0 mm to 6.0 mm, while the bent front end of the master key is ranging from 2.5 mm to 3.0 mm; the inner lock cylinder is furnished with a space having a height of 3.0 mm for applying force. The slot of such lock device has a shape, which enables a master key to plug in and to move back and forth so as to pick the tumblers and to unlock the lock device.

SUMMARY OF THE INVENTION

The prime object of the present invention is to provide a lock device, in which the center line between the lock casing and the rotary cylinder is furnished with a plurality of tumblers arranged regularly; a key slot is furnished under the tumbler grooves of the rotary cylinder, and it is two U-shaped key slots. The center of the U-shaped key slot has a salient plate, of which both sides are furnished with symmetrical guide slots; the space between the two guide slots are used for receiving the curve surface of the lower tumblers. Since the space is quite narrow and the contact point is a curved one, a very thin master key plugged in will be very difficult to push the lower tumblers as a result of the sloping contact point; the master key might be damaged or broken.

Another object of the present invention is to provide a lock device, in which the key slot of the rotary cylinder is a U-shaped hole, which includes two symmetrical guide slots and a bottom slot; the bottom surface thereof has a height of 1.0 mm only, which can prevent a master key from plugging into the curve center of the lower tumbler to pick the lock device.

Still another object of the present invention is to provide a lock device, in which the key slot of the rotary cylinder is a U-shaped hole, which includes two symmetrical guide slots and a bottom slot; the width of the two symmetrical guide slots is merely 1.0 mm, and the height thereof is less than 2.5 mm so as to limit the thickness and the height of a master key, and to reduce the space for the master key to push the lower tumbler to move.

A further object of the present invention is to provide a lock device, in which the key slot includes two symmetrical guide slots; the lower tumblers loaded in the tumbler grooves have curve surfaces on the bottoms thereof loaded in the guide slots respectively; since the master key is usually made of a saw blade, which is to be used together with an electro-motive tool; in that case, the master key is subject to breaking as a result of heavy resistance; the master key may be made of a steel wire, but the master key is susceptible to being bent upon the end thereof applied with heavy resistance.

A still further object of the present invention is to provide a lock device, in which the key to be plugged into the key slot of the rotary cylinder has symmetrical U-shaped key slot. The guide slot between the symmetrical guide plates is directed along the salient plate between the symmetrical guide slots; the lower tumblers are in the center of the salient plate. The top surface of the two symmetrical guide plates is drilled with a plurality of unlock-tumbler holes having different depth so as to push the plural lower tumblers to move upwards, and to have the top surface of all the lower tumblers reached the rotary tangent between the lock casing and the rotary cylinder; then, the key can drive the rotary cylinder to the unlock position.

Yet another object of the present invention is to provide a lock device, in which key plugged in the key slot of the rotary cylinder has two symmetrical guide plates, between which a guide slot is furnished; the unlock-tumbler holes for pushing the lower tumblers are furnished inside the two symmetrical guide plates; the unlock-tumbler holes are designed into a shape or a tapered surface to fit the curve surface of every lower tumbler; the symmetrical guide plates are divided into several equal sections. When the two symmetrical guide plates are drilled with unlock-tumbler holes, the depth thereof will be varied accordingly; likewise, the length of every lower tumbler will also be varied so as to have a smaller space to prevent a master key from pushing the lower tumblers to move, i.e., the master key will be unable to push all the lower tumblers up to the rotary tangent between the lock casing and the rotary cylinder; in other words, the master key is never able to unlock the lock device.

DETAILED DESCRIPTION OF THE PREFERRED EMBODIMENT

Figure 1:
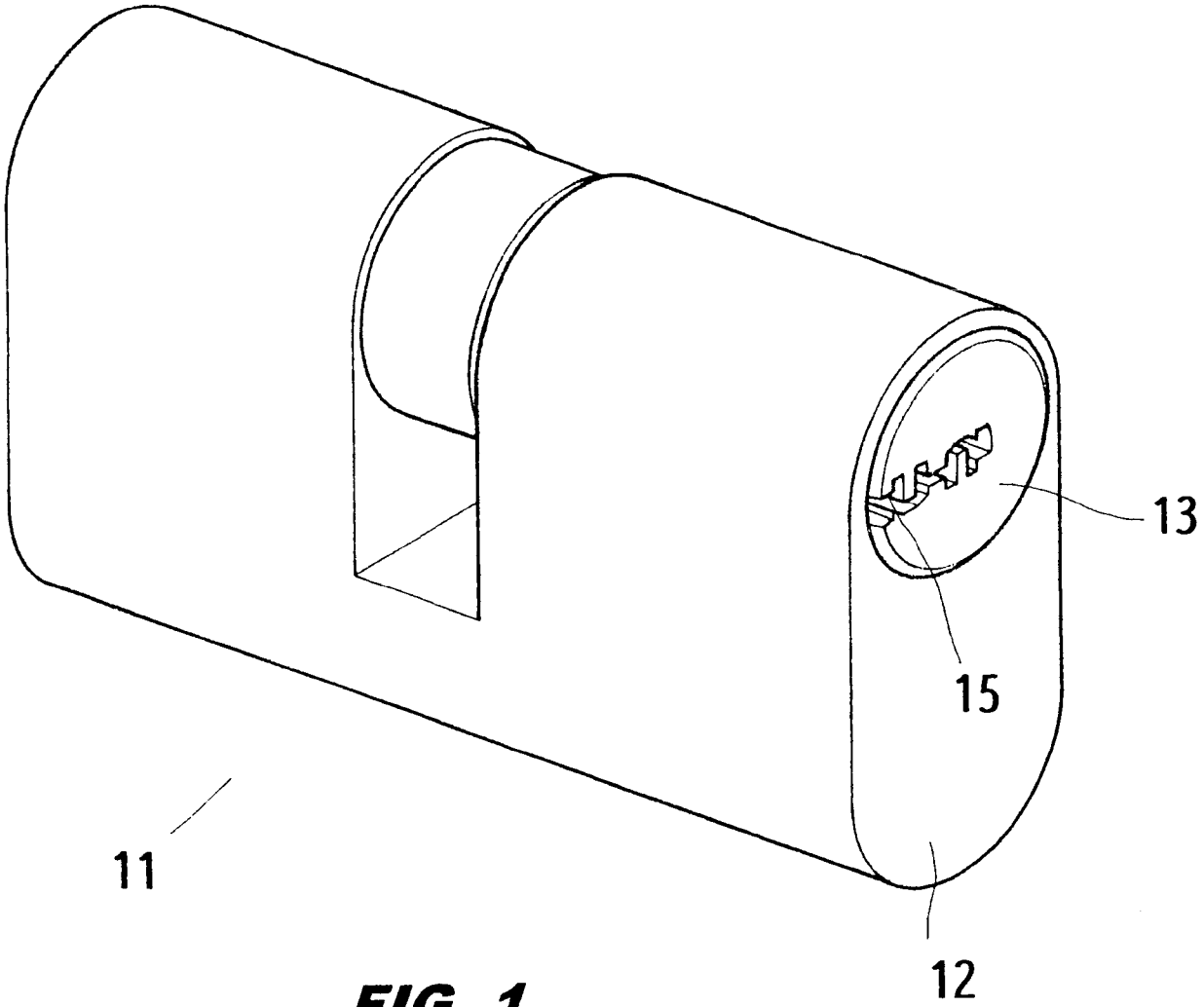
FIG. 1 is a perspective view of the present invention.

This invention relates to a picklock-proof key slot for a lock device and a key thereof; as shown in FIGS. 1 to 5, the lock device 11 comprises a lock casing 12, a rotary cylinder 13, a plurality of springs 16, a plurality of upper tumblers 17 and lower tumblers 18. The lock casing 12 has a cylindrical hole for receiving the rotary cylinder 13. Along the center-line between the lock casing 12 and the rotary cylinder 13, at least two through tumbler grooves 41 and 42 are furnished in series; the bottom of the tumbler groove 41 is provided with a key slot 15. The tumbler grooves 41 and 42 are used for receiving the lower tumblers 18, the upper tumblers 17 and the springs 16 in series; one end of the tumbler groove 42 is mounted with an outer fixed member 19 to prevent the parts in the tumbler grooves 41 and 42 from dropping out.

The upper tumbler 17 in the tumbler grooves 41 and 42 is pushed with a spring 16 to pass across the rotary tangent 20 under the tumbler groove 42 so as to be mounted in the tumbler groove 41 of the rotary cylinder 13. The distance of the upper tumbler 17 to extend into the tumbler groove is determined in accordance with the length of the lower tumbler 18, and such distance enables the lock device 11 to have more variation of unlocking code.

Figure 6:
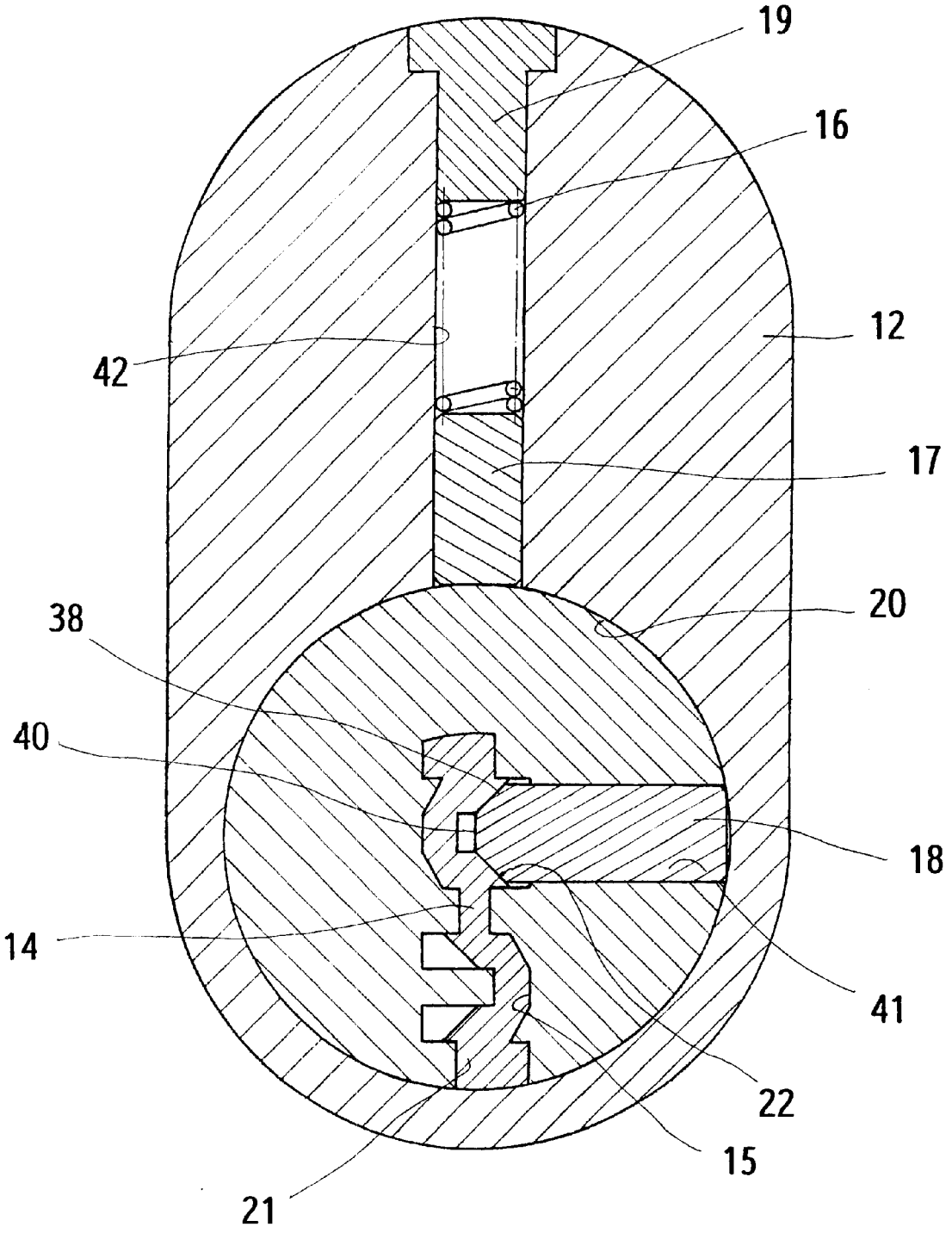
FIG. 6 is a sectional view of the present invention, showing the lock device in unlocking condition.

After a key 14 is plugged into the key slot 15, the upper tumblers 17 in the tumbler grooves 41 and 42, will be pushed by the lower tumblers 18 to a contact point, i.e., a rotary tangent 20 between the rotary cylinder 13 and the lock casing 12 so as to rotate the lock cylinder to unlock the lock device (as shown in FIG. 6).

Figure 2:
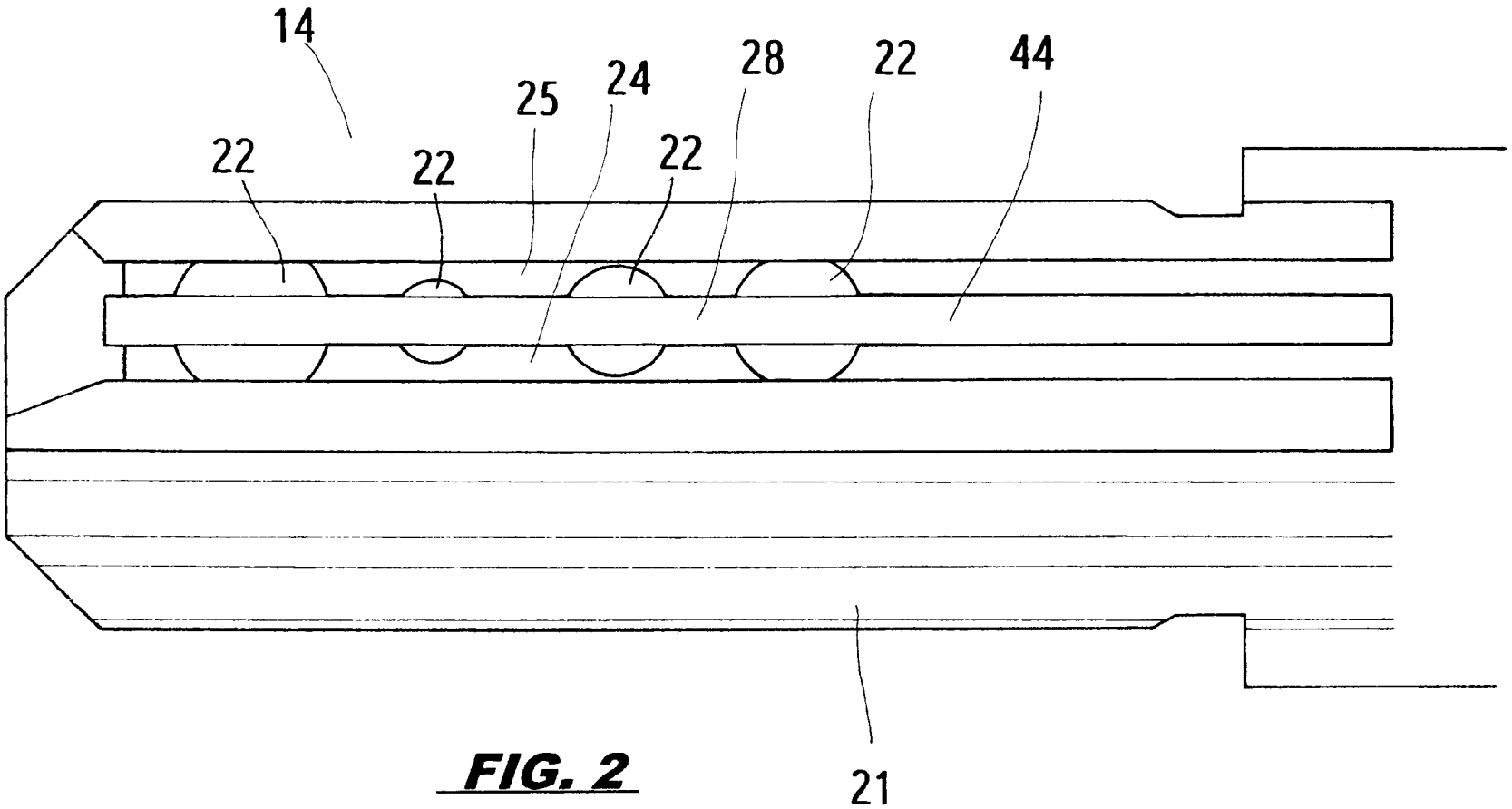
FIG. 2 is a plan view of a key according to the present invention.
Figure 3:
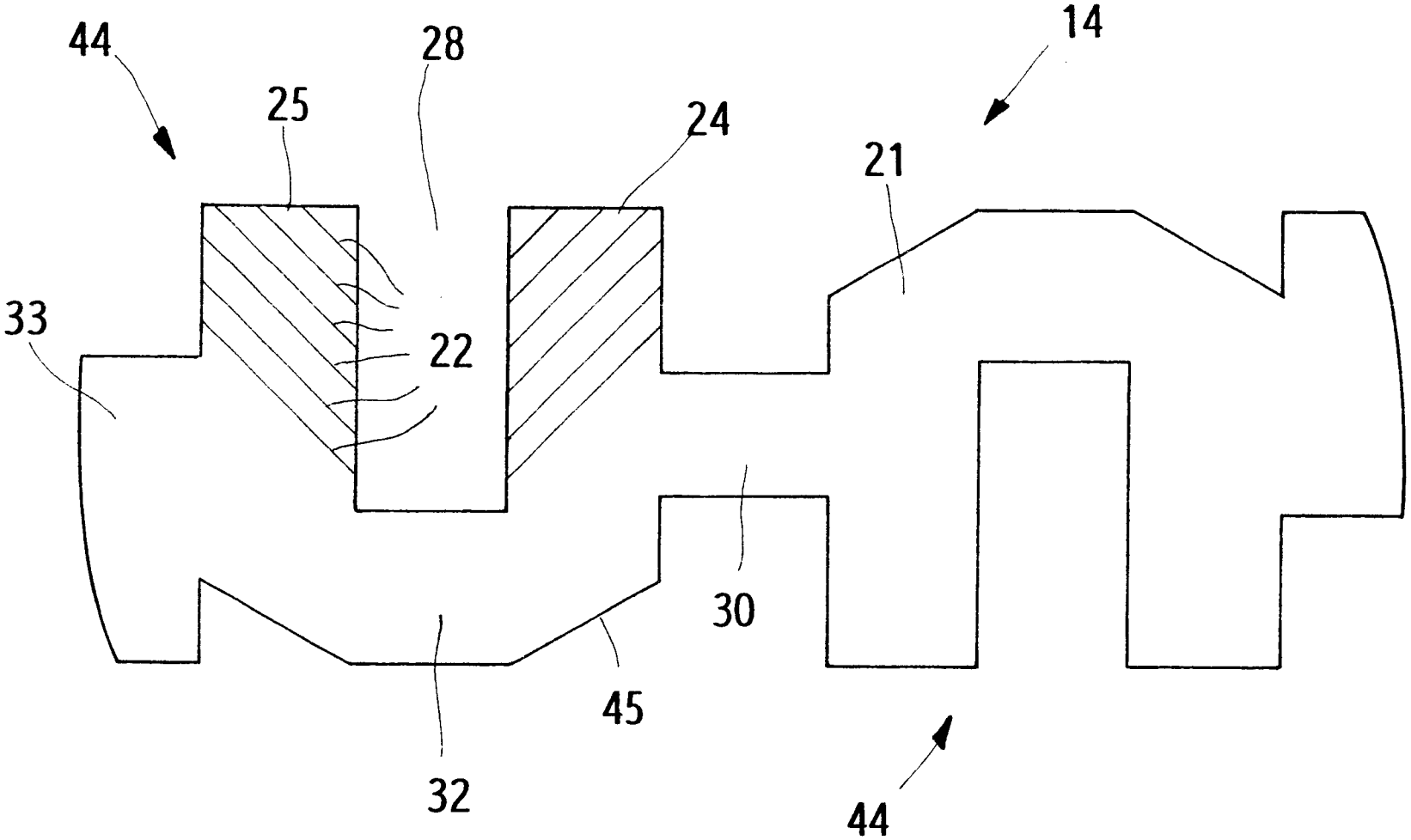
FIG. 3 shows a structure of the key plate according to the present invention.

The key 14 used for pushing the lower tumbler 18 in the tumbler groove 41 of the lock cylinder 13 to unlock the lock device is shown in FIGS. 2 and 3, and the key plate 21 of the key 14 includes a positive side and a negative side, each side is furnished with a U-shaped rib 44; either the positive side or the negative side of the key plate 21 on the key 14 may be plugged into the key slot 15 of the rotary cylinder 13, the U-shaped rib 44 on the key plate 21 will be set right under the tumbler groove 41 to push the lower tumblers 18. The key plate 21 of the key 14 includes two portions (left and right) which are divided with a connection plate 30; each portion includes two parallel guide plates 24 and 25, a bottom plate 32 and a clamp plate 33; both parallel guide plates 24 and 25 have the same thickness; a guide slot 28 is furnished between the two guide plates 24 and 25; the width of the guide slot 28 is better to be equal to the thickness of each guide plate 24 or 25; the depth of the guide slot 28 is about equal to two times the width thereof. The clamp plate 33 beside the U-shaped rib 44 has a given thickness, and it is used for providing a clamp side upon the key 14 being duplicated. Both sides of the bottom of the U-shaped rib 44 has a bevel surface 45, which is varied with the shape of the key slot 15 of the rotary cylinder 13 so as to prevent an incorrect key from plugging into the key slot 15.

Figure 4:
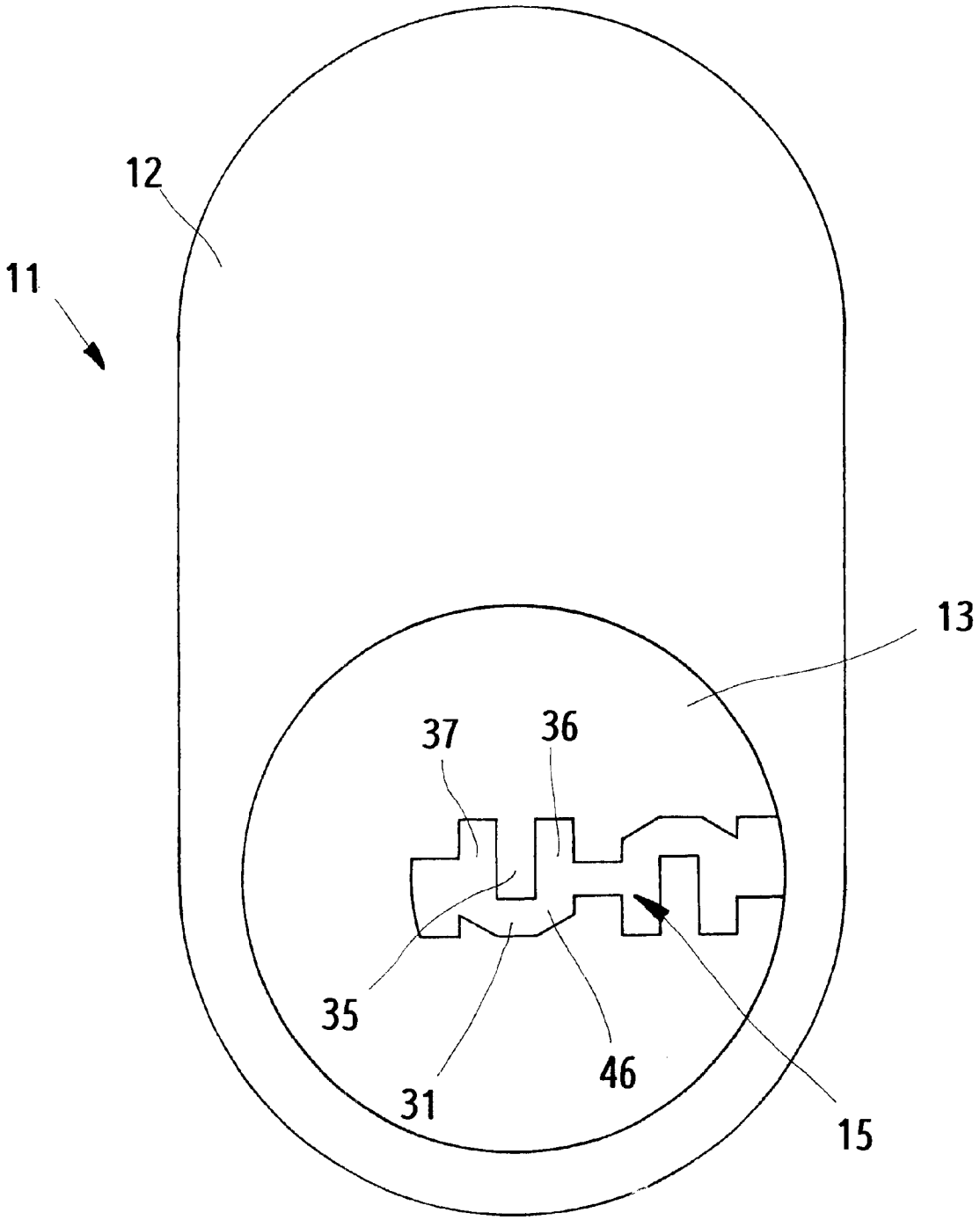
FIG. 4 is a plan view of the lock device of the present invention, showing the position of a key slot of the rotary cylinder.
Figure 5:
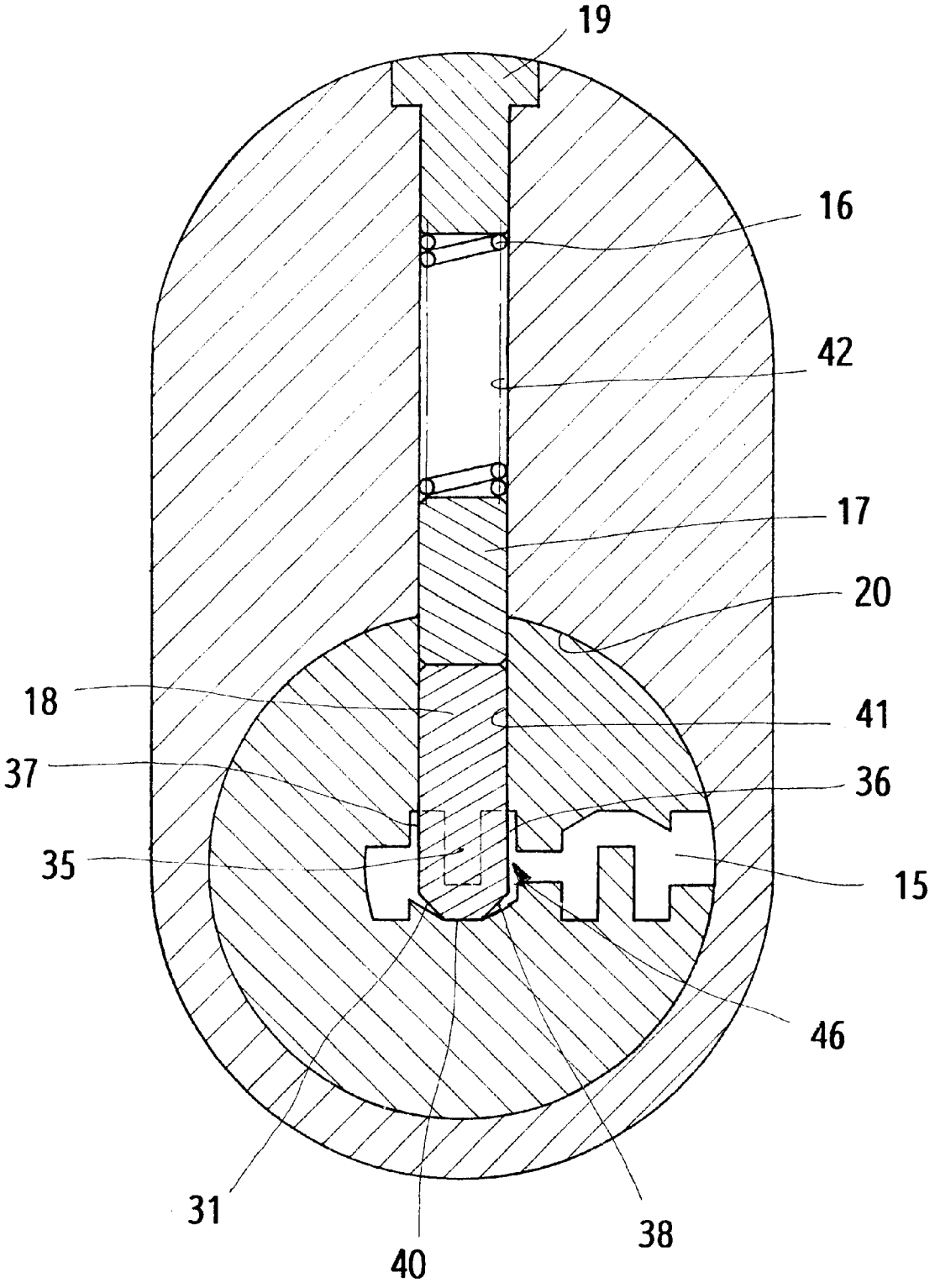
FIG. 5 is a sectional view of the present invention, showing the relation between the locking casing and the rotary cylinder.

The key plate 21 with symmetrical U-shaped ribs 44 is used for turning the rotary cylinder 13 to unlock the lock device 11; the shape of the key slot 15 in the rotary cylinder 13 should match and vary with the shape of the key plate 21 of the key 14; then, plug the key plate 21 into the key slot 15 so as to push the lower tumbler 18 of the rotary cylinder 13. As shown in FIG. 4, the key slot 15 is furnished with a U-shaped groove 46 for fitting the U-shaped rib 44; the U-shaped groove 46 includes two parallel guide slots 36 and 37, and a bottom slot 31; a salient plate 35 is provided between the two guide slots 36 and 37. Referring to FIG. 5, the salient plate 35 in the center of the U-shaped groove 46 is located at outer edge of the center line of the tumbler groove 41 of the rotary cylinder 13; the salient plate 35 almost covers the push area of the tumbler groove 41; the bottom slot 31 under the salient plate 35 has a height only 1.0 mm, which can only receive the key plate 21 to match the key slot 15, i.e., a master key can never push the lower tumbler 18 to move from the bottom slot 31.

The lower tumbler 18 mounted in the tumbler groove 41 of the lock cylinder 13 is normally pushed downwards by the upper tumbler 17, and the curve center 40 of the lower tumbler 18 will be in contact with the bottom of the bottom slot 31; then, the cylindrical surface 38 of the lower tumbler 18 on the curve center 40 will be set between the two guide slots 36 and 37 of the key slot 15. Since the height of the guide slots 36 and 37 is less than 2.5 mm, a thin master key (normally being 0.8 mm) can be plugged into the guide slots 36 and 37, but it is unable to make any slope motion, i.e., the moving space of the master key is confined, and unable to push the cylindrical surface 38 of the lower tumbler 18 to move. Since the master key can not push the lower tumbler 18 to move, the upper rotary tangent 20 of the lower tumbler 18 can not be pushed to move.

If the master key is a thinner plate, it may be able to push the lower tumbler 18 to move; however, the hook end of the master key is subject to slipping upon the cylindrical surface 38; in that case, the pushing force will be useless. When the cylindrical surface 38 of the lower tumbler 18 is pushed with the hook end of a master key, the lower tumbler 18 will have different component of force upon being and the lower tumbler 18 would not be pushed upwards. When a master key pushes a lower tumbler 18 to move upwards, a component of force would be resulted; such component of force would be a resistance to the lower tumbler 18 upon being pushed with a master key; if the master key is too thin, the hook portion of the master key might be bent, and the pushing force to the lower tumbler 18 might be lost. When using an electro-motive master key trying to push a plurality of lower tumblers 18 to move upwards, the hook portion of the master key would be broken as a result of the resistance.

The key slot 15 of the lock cylinder 13 in the lock device 11 is furnished with a symmetrical U-shaped groove 46; as soon as the key 14 is pulled out of the key slot 15, the lower tumbler 18 in the tumbler groove 41 will be pushed by the spring 16 to move downwards to the bottom slot 31 of the key slot 15; since the plural lower tumblers 18 are hindered by the salient plate 35, only a key 14 to fit the U-shaped groove 46 can be plugged in. After a key 14 able to push the plural lower tumblers 18 to the rotary tangent 20 is plugged in, the unlock tumbler slots 22 furnished on the two parallel guide plates 24 and 25 will push the tumblers up to the unlock position (i.e., the upper ends of the lower tumblers all reach the rotary tangent 20), and then the key 14 can turn the lock cylinder 13 to unlock the lock device 11.

The key plate 21 of the key 14 is furnished with U-shaped ribs 44, which include two parallel guide plates 24 and 25 and a guide slot 28; the guide slot 28 is divided into several equal sections, and each section has a tumbler groove 41 with different depth and diameter. After the key 14 is plugged into the key slot 15, the unlock-tumbler slots 22 on the key plate 21 will push the lower tumblers 18 to move upwards until the top surface of every lower tumbler 18 reaching the rotary tangent 20 between the lock casing 12 and the rotary cylinder 13; then, the key 14 can be turned to unlock the lock device as shown in FIG. 6.

When a master key is plugged into the two guide slots 36 and 37 on both sides of the U-shaped groove 46, it not only pushes the first lower tumbler 18 to move, but also has to push back and forth to have every lower tumbler moved until every lower tumbler being pushed up to the rotary tangent so as to unlock the lock device. After a master key is plugged into the guide slots 36 and 37, it would be almost impossible to push the lower tumbler 18 to move in the guide slots 36 and 37 because of being limited by the depth and width of the slots, and causing a component of force upon pushing the lower tumbler 18; further more, the master key in the slots might be broken or damaged upon a force being applied thereto.

The lock cylinder 13 is furnished with a U-shaped groove 46, and the key plate 21 of the key 14 is provided with symmetrical U-shaped ribs 44; the outer ends of the key plate is furnished with clamp plate 33; the center of the lower tumbler 18 in the lock cylinder 13 has a salient plate 35 to prevent the master key from picking directly; both sides of the U-shaped rib 44 are furnished with unlock-tumbler slots 22 for pushing the lower tumbler 18 to move so as to prevent a master key from pushing the lower tumbler 18. Apparently, the embodiment of the present invention has shown obvious improvement, which is never anticipated and achieved by any person in the field; the structure of the present invention is also deemed unique.

What is claimed is:

1. A picklock-proof lock device having a key slot and a key fitting into the key slot, the lock device including a lock casing, a rotary cylinder in the lock casing movable between locked and unlocked positions, a plurality of first tumbler grooves in the lock casing and a plurality of second tumbler grooves in the rotary cylinder, the first and second tumbler grooves being aligned with each other when the rotary cylinder is in the locked position, a plurality of first tumblers located in the first tumbler grooves, a plurality of second tumblers located in the second tumbler grooves, and comprising:

a) a key plate on the key, the key plate including two spaced apart U-shaped ribs, the U-shaped ribs facing in opposite directions with a connection plate connecting the two U-shaped ribs together, each U-shaped rib including two spaced apart parallel guide plates defining a guide slot therebetween, and a bottom plate connecting the parallel guide plates, the two spaced apart parallel guide plates having a plurality of different depth tumbler slots;

the connection plate being spaced inwardly from outer edges of the guide plates to be free of tumbler engaging slots; and, b) a key slot in the rotary cylinder including two spaced apart, U-shaped grooves configured to accommodate therein the two U-shaped ribs, and salient plates located in the U-shaped grooves to engage the guide slots of the key when the key is inserted into the key slot.

2. The picklock-proof lock device of claim 1 further comprising: first bevel surfaces on the bottom plates and matching second bevel surfaces on the U-shaped grooves.

3. The picklock-proof lock device of claim 1 having clamp plates on opposite side edges of the key plate.

4. The picklock-proof lock device of claim 1 wherein the two spaced apart guide plates have the same thickness.

5. The picklock-proof lock device of claim 4 wherein the guide slot has a width equal to the thickness of the guide plates.

6. The picklock-proof lock device of claim 5 wherein a depth of the guide slot is twice the width of the guide slot.

* * * * *